US008286614B2

(12) United States Patent
Zbytowski

(10) Patent No.: US 8,286,614 B2
(45) Date of Patent: Oct. 16, 2012

(54) CARBURETOR LIMITER CAP DEVICE

(75) Inventor: Eric G Zbytowski, Alpena, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 911 days.

(21) Appl. No.: 12/329,567

(22) Filed: Dec. 6, 2008

(65) Prior Publication Data

US 2009/0145408 A1 Jun. 11, 2009

(30) Foreign Application Priority Data

Dec. 7, 2007 (JP) ..... 2007-316679

(51) Int. Cl.

| | |
|---|---|
| ***F02M 5/10*** | (2006.01) |
| ***F02M 3/10*** | (2006.01) |
| ***E03B 1/00*** | (2006.01) |
| ***E03B 3/00*** | (2006.01) |
| ***F16K 27/08*** | (2006.01) |
| ***F16L 35/00*** | (2006.01) |
| ***F16P 1/00*** | (2006.01) |
| ***F17D 1/00*** | (2006.01) |

(52) U.S. Cl. ..... 123/517; 261/71; 261/DIG. 84; 137/382; 137/382.5

(58) Field of Classification Search ..... 123/517; 261/71, DIG. 84; 137/382, 382.5
See application file for complete search history.

(56) References Cited

U.S. PATENT DOCUMENTS

| | | | | |
|---|---|---|---|---|
| 5,236,634 | A * | 8/1993 | Hammett et al. | 261/71 |
| 5,667,734 | A * | 9/1997 | Ohgane | 261/71 |
| 5,753,148 | A * | 5/1998 | King et al. | 261/71 |
| 6,302,384 | B1 * | 10/2001 | Douyama | 261/71 |
| 7,097,165 | B1 * | 8/2006 | Braun | 261/71 |
| 2005/0173816 | A1 * | 8/2005 | Vick et al. | 261/71 |

FOREIGN PATENT DOCUMENTS

| | | |
|---|---|---|
| JP | 8319893 | 3/1996 |

* cited by examiner

*Primary Examiner* — Stephen K Cronin
*Assistant Examiner* — Sizo Vilakazi
(74) *Attorney, Agent, or Firm* — Reising Ethington P.C.

(57) ABSTRACT

An adjustment limiting device for a carburetor including a fuel adjustment valve rotatable to adjust a supply of fuel in or delivered from the carburetor includes an adjustment limiting cap and a connector. The adjustment limiting cap is adapted to be disposed over a portion of the fuel adjustment valve and includes a rotary connection feature adapted to limit relative rotational movement between the adjustment limiting cap and the fuel adjustment valve, and a rotation limiter to limit rotational movement of the adjustment limiting cap. The connector may be carried by the adjustment limiting cap to maintain the adjustment limiting cap on the fuel adjustment valve. The connector may be concealed by the carburetor body, permit the adjustment limiting cap to be fitted onto the fuel adjustment valve, and prevent the adjustment limiting cap from being removed from the fuel adjustment limiting valve.

16 Claims, 5 Drawing Sheets

CARBURETOR LIMITER CAP DEVICE

TECHNICAL FIELD

The present disclosure relates generally to fuel control valves, and more particularly to a device for limiting adjustment of a fuel adjustment valve of a carburetor.

BACKGROUND OF THE DISCLOSURE

The range of adjustment of a fuel adjustment valve provided on a carburetor main body may be limited to prevent an end user from increasing the supply of fuel delivered from the carburetor beyond a designed limit to comply with the regulations on the emission of small internal combustion engines. Some fuel adjustment valves include a needle member whose tip is configured to move into and out of a fuel passage provided in the carburetor main body so as to regulate the flow of fuel through the fuel passage.

To effect such a movement of the fuel adjust valve (needle member), a threaded hole is formed in the carburetor main body, and the fuel adjustment valve is threaded into this threaded hole so that the needle member may be advanced and backed out as desired by turning the fuel adjustment valve by using a suitable tool.

SUMMARY OF THE DISCLOSURE

An adjustment limiting device for a carburetor including a fuel adjustment valve provided in a carburetor main body and rotatable to adjust a supply of fuel in or delivered from the carburetor includes an adjustment limiting cap and a connector. The adjustment limiting cap is adapted to be disposed over a portion of the fuel adjustment valve and includes a rotary connection feature adapted to limit relative rotational movement between the adjustment limiting cap and the fuel adjustment valve, and a rotation limiter to limit rotational movement of the adjustment limiting cap. The connector may be carried by the adjustment limiting cap and adapted to engage the fuel adjustment valve to maintain the adjustment limiting cap on the fuel adjustment valve. The connector may be concealed by the carburetor body, permit the adjustment limiting cap to be fitted onto the fuel adjustment valve, and prevent the adjustment limiting cap from being removed from the fuel adjustment limiting valve.

An adjustment limiting device for a carburetor including a fuel adjustment valve provided in a carburetor main body and rotatable to adjust a supply of fuel in or delivered from the carburetor may include an adjustment limiting cap and a connector. The adjustment limiting cap may be rigid and disposed over a portion of the fuel adjustment valve and include a rotary connection feature adapted to engage the fuel adjustment valve to limit relative rotational movement between the adjustment limiting cap and the fuel adjustment valve. The cap may include a rotation limiter for limiting an angular range of the rotational movement of the adjustment limiting cap relative to the carburetor body. The connector may be carried by the adjustment limiting cap and having a projection adapted to extend radially inwardly of the adjustment limiting cap to radially overlap a portion of the fuel adjustment valve in assembly and retain the adjustment limiting cap on the fuel adjustment valve. In at least one implementation, the connector is flexible such that the projection is displaced radially outwardly by a larger diameter portion of the fuel adjustment valve as the adjustment limiting cap is fitted over the fuel adjustment valve and the connector is resilient to return to its unflexed position when the projection is not displaced by and is received in a smaller diameter portion of the fuel adjustment valve.

BRIEF DESCRIPTION OF THE DRAWINGS

FIG. 4(*b*) is an end view as seen from the direction indicated by arrow IV in FIG. 4(*a*);

FIG. 5(*b*) is a fragmentary sectional view showing a further step in the process of assembling the adjustment limiting cap onto a fuel adjustment valve;

FIG. 6(*b*) is a perspective view of two adjustment limiting caps.

DETAILED DESCRIPTION OF PREFERRED EMBODIMENTS

Figure 1:
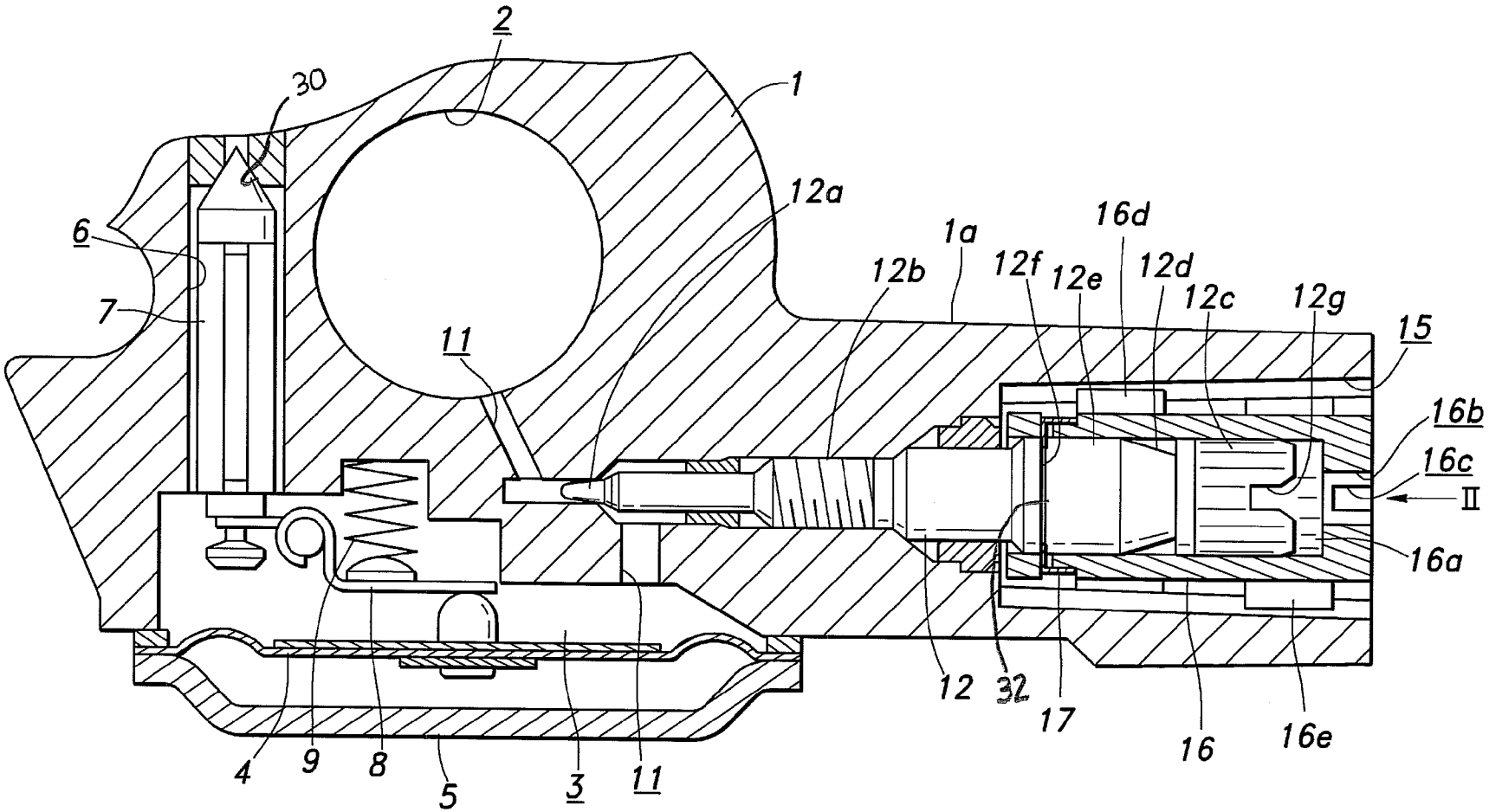
FIG. 1 is a fragmentary sectional view of one implementation of a carburetor.

Referring in more detail to the drawings, FIG. 1 illustrates part of a carburetor including a fuel adjustment valve on which an adjustment limiting device may be received to limit adjustment of the valve by an end user. In this drawing, various components and passages are illustrated as if they were located in the same plane or cross section for the purpose of illustration, but, in fact, may be located on different planes which may be located either on the other side or on this side of the paper.

In the illustrated embodiment, the carburetor main body 1 includes an intake bore 2 extending perpendicularly to the plane of the paper, and a fuel pressure regulating chamber 3. The fuel pressure regulating chamber 3 may be defined by a recess formed in the carburetor main body 1 and a diaphragm 4 covering the recess. The other side of the diaphragm 4 may be surrounded by a cover 5 including a vent (not shown) open to ambient so as to define an atmosphere chamber between the cover 5 and diaphragm 4.

An inlet to the fuel pressure regulating chamber 3 is communicated with a fuel supply passage (not shown) and receives a fuel inlet valve 7 in a coaxial relationship. The lower end of the fuel inlet valve 7 as seen in the drawing is connected to an end of a lever 8 pivotally supported in the fuel pressure regulating chamber 3, and the other end of the lever 8 engages a projection attached to a central part of the diaphragm 4. An intermediate point of the lever 8 is urged by a coil spring 9 so as to axially push the other end of the lever 8 against the central projection of the diaphragm 4. A head of the inlet valve 7 is moved relative to a valve seat 30 to control fuel flow into the fuel pressure regulating chamber 3 from a fuel pump which may also be diaphragm actuated as is known in the art.

The fuel pressure regulating chamber 3 communicates with the intake bore 2 via a fuel passage 11. The carburetor main body 1 may be formed with a projection 1*a* projecting laterally outwardly of the fuel passage 11. Inside the projection 1*a*, a rod-shaped fuel adjustment valve 12 may be received in a hole that opens out at the free end of the projection 1*a* and extends to the fuel passage 11. A needle-shaped free end 12*a* of the fuel adjustment valve 12 is configured as a valve member that changes the open area of the fuel passage 11 to control the flow rate of fuel through the fuel passage 11.

Figure 2:
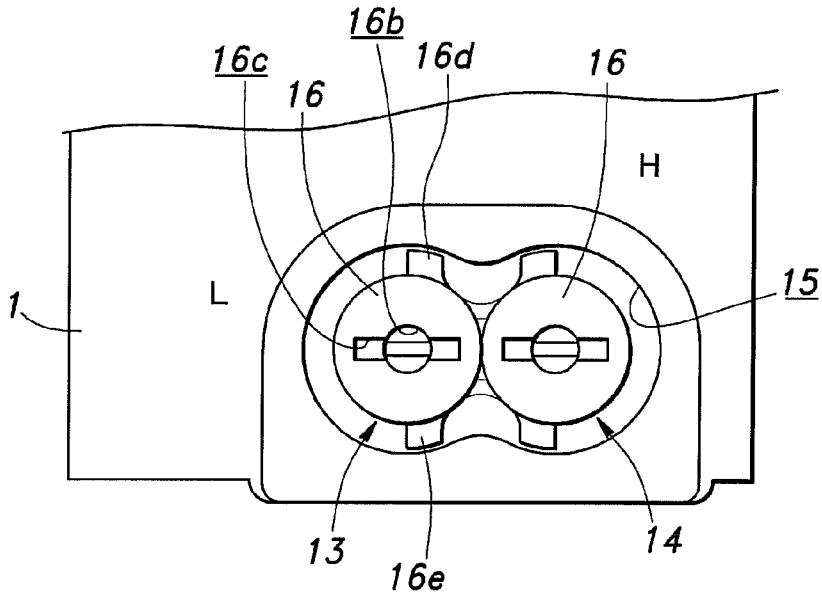
FIG. 2 is a fragmentary end view as seen from the direction indicated by arrow II in FIG. 1.

Two such fuel adjustment valves 12 may be provided as shown in FIG. 2. One may be a low speed fuel adjustment valve 13, and the other may be a high speed fuel adjustment valve 14. As they may have an identical structure, only the low speed fuel adjustment valve 13 is described in the following as representing both the fuel adjustment valves 12 unless otherwise specified.

The fuel adjustment valve 12 may include a needle shaped free end 12*a*, a stem portion connected to the free end 12*a* and formed with a threaded portion 12*b* in an intermediate portion thereof and an end portion 12*c* having one or more rotary connection features such as serrations formed in an outer circumferential surface of a head provided on the axial end of the fuel adjustment valve 12 remote from the free end 12*a*. Between the end portion 12*c* and threaded portion 12*b* there may be formed a tapered portion 12*d* having a progressively increasing diameter from a small diameter portion thereof, a barrel portion 12*e* which may have a constant diameter which may be the same as the maximum diameter of the tapered portion 12*d* and a circumferential groove 12*f* having a reduced outer diameter as compared with that of the barrel portion 12*e*. The grove may define at least one shoulder 32 and that shoulder may be generally planar and perpendicular to the axis of rotation of the adjustment valve 12.

The fuel adjustment valve 12 is threaded into the carburetor main body 1 by means of the threaded portion 12*b* so that the needle-shaped free end 12*a* can be displaced axially in the fuel passage 11 by turning the fuel adjustment valve 12, and the effective cross sectional flow area of the fuel passage 11 changes in dependence on the angular and hence, axial position of the fuel adjustment valve 12.

Figure 3:
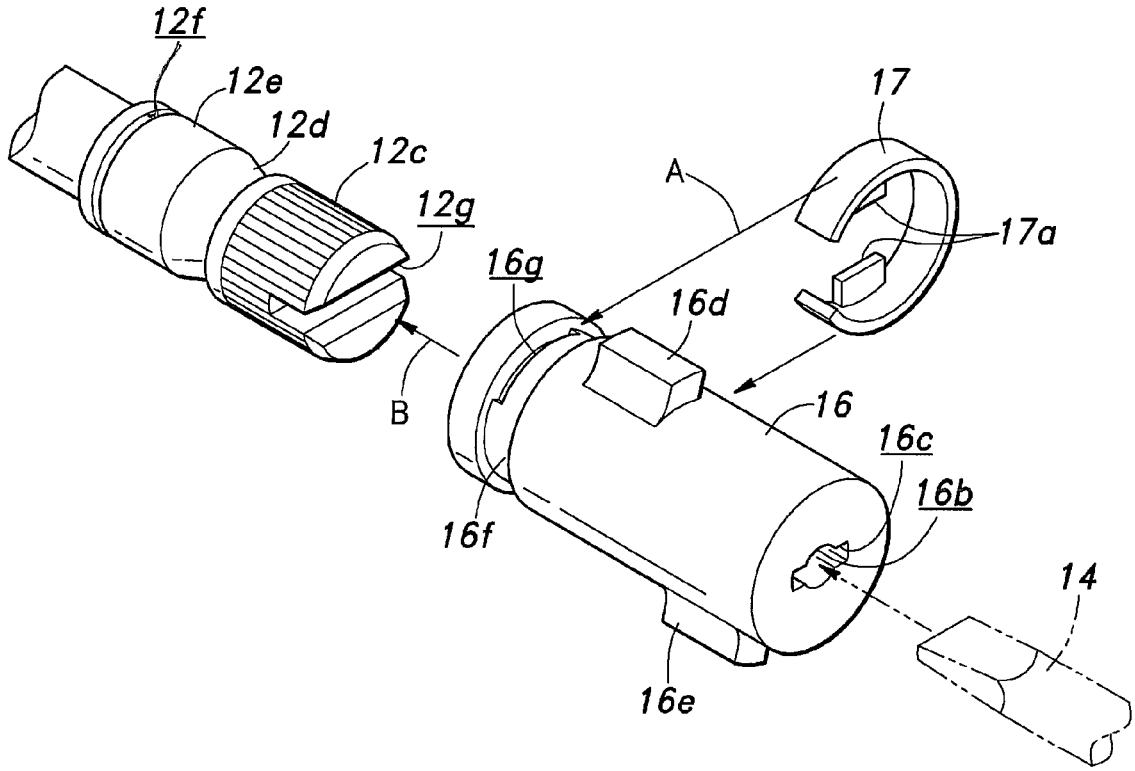
FIG. 3 is an exploded perspective view of one implementation of an adjustment limiting device.
Figure 4A:
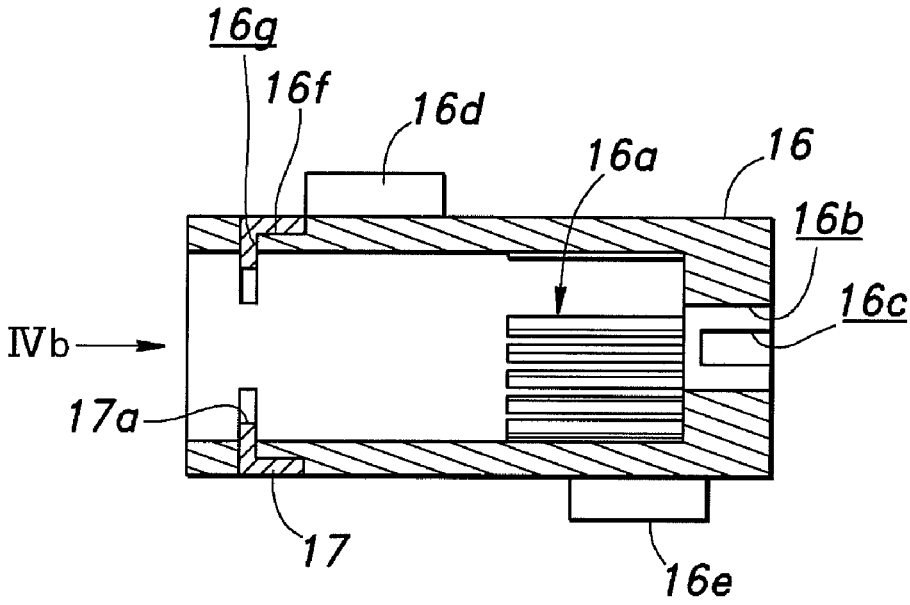
FIG. 4(*a*) is a vertical sectional view of an adjustment limiting cap.
Figure 4B:
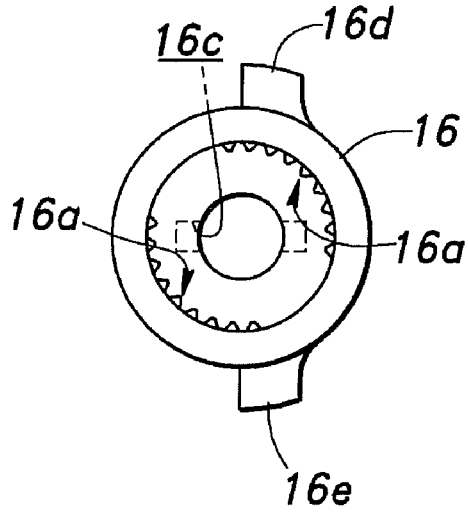

In the assembled state of the carburetor, the fuel adjustment valve 12 may be completely sunk into the carburetor main body 1 so that a tool 14 is required for its adjustment as shown in FIG. 3 (in other words, the projection 1*a* prevents access, by hand, to the fuel adjustment valve 12. A tool engagement feature, such as a slot 12*g* may be formed on or in the rear end of the fuel adjustment valve 12*c* adjacent to the end portion 12*c* so that the tool (such as a screwdriver) 14 may be engaged with the slot 12*b* and the fuel adjustment valve 12 may be turned.

As best shown in FIG. 2, the carburetor main body 1 may be formed with a cavity or receiving hole 15 for receiving the fuel adjustment valves 12 in their assembled state over a length thereof that may extend from the end portion 12*c* to the circumferential groove 12*f* with a certain circumferential gap defined therebetween. When two adjustment valves 12 are used, the receiving hole 15 may be provided with a cross sectional shape of two circles that are laterally arranged and merged with each other.

When the fuel adjustment valve 12 is assembled into the carburetor main body 1, an adjustment limiting cap 16 is fitted on the fuel adjustment valve 12. The cap 16 may be generally cup-shaped with an inner recess or cavity sufficient to extend over the end portion 12*c* and the circumferential groove 12*f*. The axial length of the adjustment limiting cap 16 may be substantially identical to the depth (axial length) of the receiving hole 15 as shown in FIG. 1 so that the serration portion 12 is fully covered by the rear end of the adjustment limiting cap 16 which may be adjacent to the exterior of the carburetor main body 1 (the end of projection 1*a* in this embodiment) in the assembled state.

The inner circumferential surface of the adjustment limiting cap 16 may be provided with one or more rotary connection feature(s) adapted to mate with or engage the rotary connection feature(s) of the valve 12. In one implementation, the cap's connection features may include an internal serration portion 16*a* configured to mesh with the end portion 12*c* of the adjustment valve 12 so as to rotatably interconnect the cap 16 and adjustment valve 12. When the carburetor is finally assembled and the adjustment limiting cap 16 is fitted on the fuel adjustment valve 12 as shown in FIG. 1, the two serration portions 12*c* and 16*a* are meshed with each other (engaged state) so that the fuel adjustment valve 12 is rotationally fast with the adjustment limiting cap 16. That is, the mated or engaged rotary connection features of the cap 16 and valve 12 may limit or prevent relative rotational movement between the cap 16 and valve 12.

The bottom wall or the rear end of the cup-shaped adjustment limiting cap 16 may be provided with an axial hole 16*b* and a diametrical slot 16*c* extending diametrically through the axial hole 16*b* and having a certain axial depth. The outer circumferential surface of the adjustment limiting cap 16 may be provided with a pair of rotational limiters (e.g. engagement pieces 16*d* and 16*e*) that limit the permitted range in which the caps may be rotated. In one implementation, the engagement pieces 16*d* and 16*e* are disposed about 180 degrees apart for determining a range of an angular movement of the fuel adjustment valve 12 when the latter is joined integrally with the fuel adjustment valve 12. The engagement pieces 16*d* and 16*e* are positioned so as to define the prescribed angular range by being engaged by the outer circumferential surface of the adjustment limiting cap 16 on an adjacent adjustment valve 12.

As shown in FIG. 3 also, the adjustment limiting cap 16 is provided with a neck portion 16*f* which is reduced in diameter from the remaining part of the adjustment limiting cap 16 at a position corresponding to the circumferential groove 12*f* when fitted on the fuel adjustment valve 12. The neck portion 16*f* is configured such that a connector 17 which may be generally C-shaped and have a width corresponding to the width of the neck portion 16*f* is received in the neck portion 16*f* with a certain resilient pressure. In this manner, the connector 17 may be retained by the adjustment limiting cap against axial movement relative to the cap. The connector 17 may be made of resilient material (e.g. spring steel or the like), and have an inner diameter slightly smaller than the outer diameter of the neck portion 16*f*. In one implementation, the cap 16 may be formed of a rigid material and if desired, may be designed such that no portion of the valve can be radially expanded under forces associated with installation or attempted removal of the cap 16.

The neck portion 16*f* may be provided with one or more engagement holes 16*g*. In the embodiment shown, there are two such holes 16*g* that open out to the inner circumferential surface of the adjustment limiting cap 16 at diametrically opposed locations. The connector 17 is provided with a pair of inwardly directed projections or engagement pieces 17*a* which may be provided at circumferentially spaced positions corresponding to the engagement holes 16*g* so as to be received thereby when the connector 17 is fitted onto the neck portion 16*f*. The engagement pieces 17*a* may be generally flat, planar projections extending radially inwardly of an outer body of the connector. The connector may be generally coaxially received on the cap 16 and the engagement pieces 17*a* may extend generally perpendicular to the rotary axis of the cap 16 (and hence the adjustment valve 12 because the cap and adjustment valve may be coaxial in assembly). The connector 17 may be formed in one-piece with the cap 16, may be separate from the cap and carried thereby such as by an adhesive, fastener, snap-fit, friction fit, weld, or the like.

The mode of operation of the adjustment limiting device for a fuel adjustment valve of a carburetor having the above described structure is now described in the following. First of all, the connector 17 is mounted on the neck portion 16*f* of the adjustment limiting cap 16 from sideways as indicated by arrows A in FIG. 3. The inwardly directed engagement pieces 17*a* of the connector 17 pass through the engagement holes 16*g* and project from the inner circumferential surface of the adjustment limiting cap 16. With the connector 17 mounted in this way, the adjustment limiting cap 16 is pushed onto the fuel adjustment valve 12 from the rear end thereof as indicated by arrow B in FIG. 3. In one implementation, the end 12*c* of the fuel adjustment valve is beveled and the adjustment limiting cap 16 can be pushed into position without encountering substantial resistance because the engagement pieces 17*a* are favorably guided by the beveled portion in the rear end of the fuel adjustment valve 12 and the connector 17 is flexed outwardly until the engagement pieces 17*a* reach the outer circumferential surface of the end portion 12*c*.

Figure 5A:
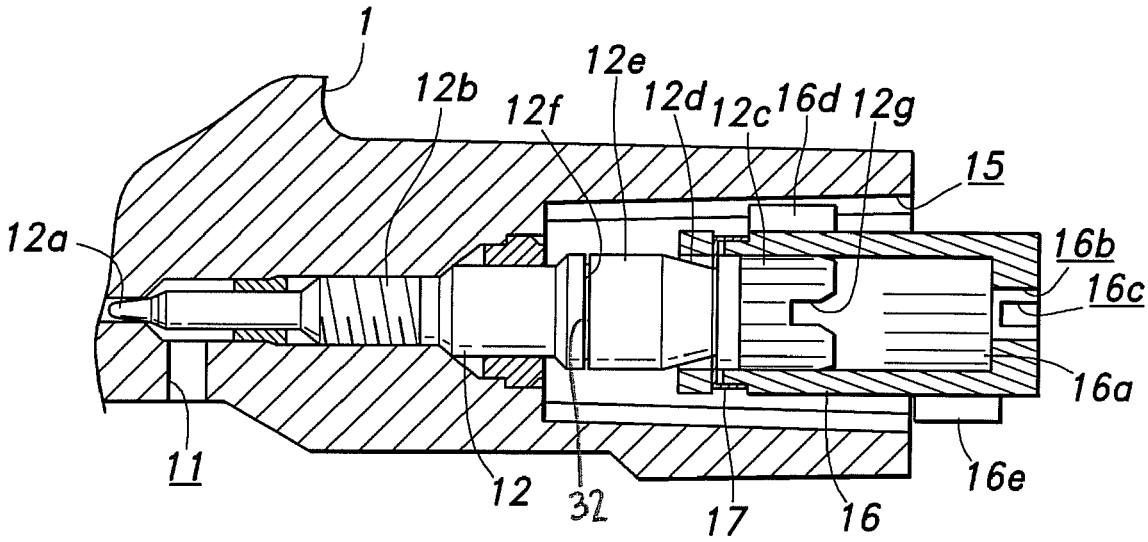
FIG. 5(*a*) is a fragmentary sectional view similar to FIG. 1 showing an early stage of assembling the adjustment limiting device following the completion of initial adjustment of the valve.
Figure 5B:
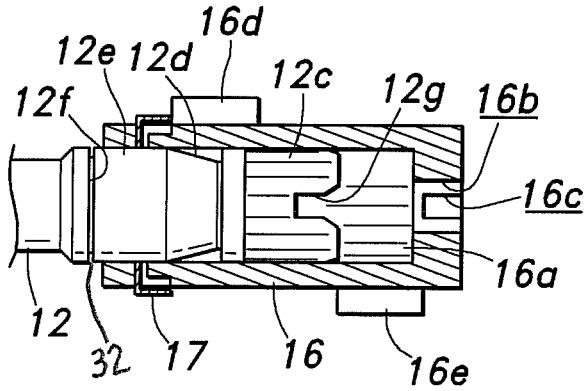

By further pushing the adjustment limiting cap 16 onto the fuel adjustment valve 12, the inwardly directed engagement pieces 17*a* reach the small diameter portion of the tapered portion 12*d* as illustrated in FIG. 5(*a*) wherein the connector may return to its normal, not flexed state. In this position of the cap 16, the fuel adjustment valve 12 may be freely adjusted (such as at the factory and before delivery to an end user), and the fuel adjustment valve 12 and adjustment limiting cap 16 can be freely turned relative to each other. Therefore, for the adjustment process at the factory, a relatively fine screwdriver (not shown in the drawings) is passed through the axial hole 16*b* in the rear end of the adjustment limiting cap 16 and engaged with the tool engaging slot 12*g* of the fuel adjustment valve 12 so that the fuel adjustment valve 12 can be turned with the screwdriver, and the adjustment or calibration for a desired fuel supply can be readily accomplished.

Once the adjustment for a desired fuel supply is completed at the factory (which may be a maximum desired fuel supply such that an end user may only reduce the fuel supply to prevent undue enrichment of the fuel mixture by the end user), one of the engagement pieces 16*e* is made to engage the outer circumferential surface of the adjacent adjustment limiting cap 16, and the adjustment limiting cap 16 is pushed further onto the adjustment valve 12 in this general angular orientation. At this time, the engagement pieces 17*a* are favorably guided by the tapered portion 12*d*, and the connector 17 is flexed outwardly once again when the engagement pieces 17*a* bear on and are displaced by the tapered portion 12*d*. Once the engagement pieces 17*a* reach the circumferential groove 12*f*, the engagement pieces 17*a* are received in the circumferential groove 12*f* as the resilient connector 17 returns to its normal, not flexed stated so that the state illustrated in FIG. 1 is achieved and the user is allowed to use the carburetor.

Removal of the adjustment limiting cap 16 from adjustment valve 12 is prevented by the engagement pieces 17*a* which are received in the circumferential groove 12*f* and radially overlap the shoulder 32 provided in that groove. In one implementation, there may be substantial overlap between the projections 17*a* and the shoulder 32, which may be generally parallel and planar such that there is little or no tendency for the projections to be outwardly displaced relative to the shoulder and the connector 17 remains in place on the cap 16. Further, the connector 17 preferably is fully received in and/or concealed by a portion of the carburetor body (such as the projection 1*a*) so that the connector 17 is not accessible by an end user and cannot be removed from the cap 16 by an end user. The extent of the radial overlap of the projections 17*a* and the shoulder may be greater than the radial distance between the outside surface of the connector and the carburetor body. In this manner, the connector will engage the carburetor body before the projections 17*a* are removed from the shoulder to prevent removal of the connector 17 from the cap 16 while the fuel adjustment valve is within the cavity 15.

Figure 6A:
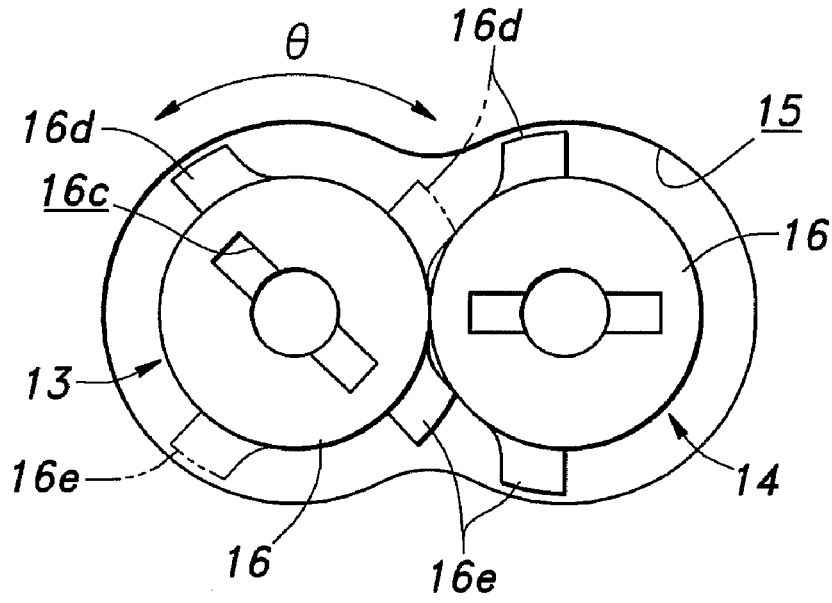
FIG. 6(*a*) is an enlarged fragmentary view similar to FIG. 2 showing a range of adjustment of the fuel adjustment valve.
Figure 6B:
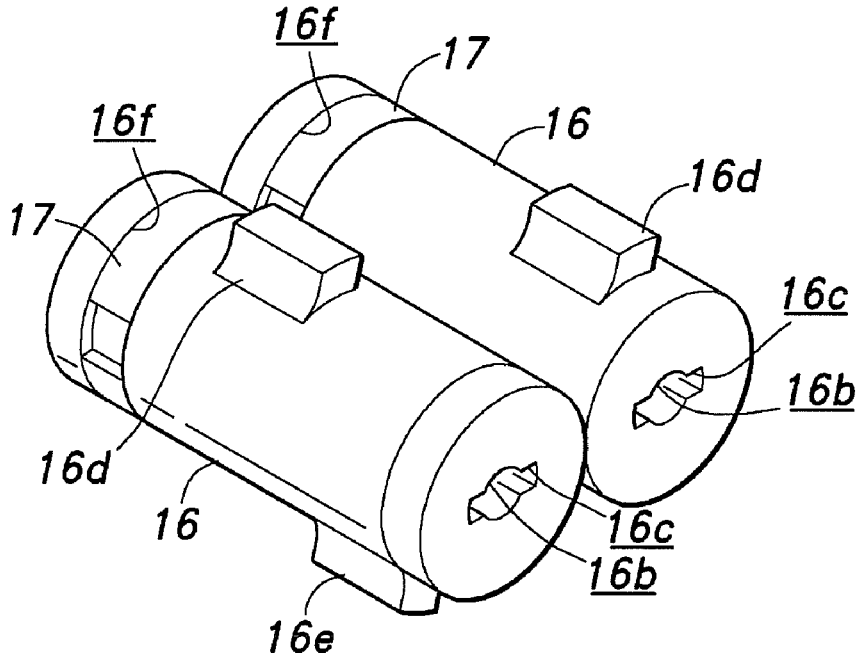

As indicated by the double-dot chain-dot line in FIG. 6(*a*), the low speed adjustment limiting cap 16 can be turned until the other engagement piece 16*d* abuts the adjacent high speed adjustment limiting cap 16 so that the range of angular adjustment is defined as indicated by angle θ shown in the drawing. The angular movement from the position indicated by the solid line to the position indicated by the chain-dot line corresponds to an adjustment for decreasing the supply of fuel. Therefore, the end user is unable to turn the fuel adjustment valve 12 in the direction to increase the supply of fuel beyond the position determined at the factory, and the emission control imposed at the factory is maintained.

If an attempt is made to directly turn the fuel adjustment valve 12 by using a fine screwdriver passed into the axial hole 16*b* in a similar manner as in the factory, because the adjustment limiting cap 16 is rotationally fast with the fuel adjustment valve 12, it does not make any difference from the attempt to turn the adjustment limiting cap 16, and the adjustment for an increase in the supply of fuel beyond the maximum value is prevented.

Also, to prevent an attempt to destroy the adjustment limiting cap 16 to gain access to the fuel adjustment valve 12, the adjustment limiting cap 16 may be made of metallic material. By making the adjustment limiting cap 16 as a die-cast component, the manufacturing process can be simplified.

As shown in FIG. 6(*b*), the engagement pieces 16*e* (16*f*) of the two adjoining adjustment limiting caps 16 directed toward each other are axially offset from each other. Thereby, the adjustment limiting caps 16 of the low speed and high speed fuel adjustment valves 12 can be turned without interference with the engagement pieces of the other.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items.

Other terms are to be construed using their broadest reasonable meaning unless they are used in a context that requires a different interpretation.

The invention claimed is:

1. An adjustment limiting device for a carburetor including a fuel adjustment valve provided in a carburetor main body and rotatable to adjust a supply of fuel in or delivered from the carburetor, the device comprises:

an adjustment limiting cap disposed over a portion of the fuel adjustment valve and including a rotary connection feature adapted to engage the fuel adjustment valve to limit relative rotational movement between the adjustment limiting cap and the fuel adjustment valve, and a rotation limiter for limiting an angular range of the rotational movement of the adjustment limiting cap;

a connector that is formed separately from and carried by the adjustment limiting cap and adapted to engage the fuel adjustment valve to maintain the adjustment limiting cap on the fuel adjustment valve, the connector is concealed by the carburetor body, permits the adjustment limiting cap to be fitted onto the fuel adjustment valve but prevents the adjustment limiting cap from being removed from the fuel adjustment valve.

2. The device of claim 1 wherein the connector is retained by the adjustment limiting cap against an axial movement and includes a projection that extends more radially inwardly than an inner circumferential surface of the adjustment limiting cap and is adapted to radially overlap a shoulder of the fuel adjustment valve.

3. The device of claim 2 wherein the adjustment limiting cap is rigid and made of metallic material.

4. The device of claim 3 wherein the adjustment limiting cap is made of a die-cast material.

5. The device of claim 1 wherein the connector is C-shaped and mounted to the adjustment limiting cap in a direction perpendicular to an axis of rotation of the fuel adjustment valve, the connector is retained by the adjustment limiting cap against axial movement of the connector and the connector includes a projection that extends perpendicular to the axis of rotation of the fuel adjustment valve.

6. The device of claim 2 wherein the connector may be flexed so that the projection is moved radially outwardly to permit the projection to clear the shoulder during installation of the adjustment limiting cap onto the fuel adjustment valve and the connector is resilient so that the projection radially overlaps the shoulder when the adjustment limiting cap is assembled onto the fuel adjustment valve.

7. The device of claim 6 wherein the connector is C-shaped.

8. The device of claim 6 wherein the adjustment limiting cap includes a hole through which the projection extends.

9. An adjustment limiting device for a carburetor including a fuel adjustment valve provided in a carburetor main body and rotatable to adjust a supply of fuel in or delivered from the carburetor, the device comprises:

a rigid adjustment limiting cap disposed over a portion of the fuel adjustment valve and including a rotary connection feature adapted to engage the fuel adjustment valve to limit relative rotational movement between the adjustment limiting cap and the fuel adjustment valve, and a rotation limiter for limiting an angular range of the rotational movement of the adjustment limiting cap relative to the carburetor body;

a connector that is formed separately from and carried by the adjustment limiting cap and having a projection adapted to extend radially inwardly of the adjustment limiting cap to radially overlap a portion of the fuel adjustment valve in assembly and maintain the adjustment limiting cap on the fuel adjustment valve, the connector is flexible such that the projection is displaced radially outwardly by a larger diameter portion of the fuel adjustment valve as the adjustment limiting cap is fitted over the fuel adjustment valve and the connector is resilient to return to its unflexed position when the projection is not displaced by and is received in a smaller diameter portion of the fuel adjustment valve.

10. The device of claim 9 wherein the smaller diameter portion of the fuel adjustment valve is defined by a groove formed in the fuel adjustment valve.

11. The device of claim 9 wherein the connector includes two circumferentially spaced projections.

12. The device of claim 9 wherein the body is formed of a die-cast metal and the connector is formed from spring steel.

13. The device of claim 9 wherein the carburetor body includes a cavity in which the adjustment limiting cap is received in assembly and the connector is received in the cavity and is not accessible by an end user.

14. The device of claim 13 wherein the cavity is formed in a projection extending outwardly from the carburetor body.

15. An adjustment limiting device for a carburetor including a fuel adjustment valve provided in a carburetor main body including a cavity in which the fuel adjustment valve is received, the fuel adjustment valve being rotatable to adjust a supply of fuel in or delivered from the carburetor, the device comprises:

an adjustment limiting cap disposed over a portion of the fuel adjustment valve and including a rotary connection feature adapted to engage the fuel adjustment valve to limit relative rotational movement between the adjustment limiting cap and the fuel adjustment valve, and a rotation limiter for limiting an angular range of the rotational movement of the adjustment limiting cap relative to the carburetor body;

a C-shaped connector formed separately from and carried by the adjustment limiting cap and having a projection extending radially inwardly of the adjustment limiting cap to radially overlap a portion of the fuel adjustment valve in assembly and thereby prevent axial removal of the adjustment limiting cap from the fuel adjustment valve, the connector being flexible and resilient such that as the adjustment limiting cap is fitted over the fuel adjustment valve the projection is displaced radially outwardly by a portion of the fuel adjustment valve larger in diameter than said portion radially overlapped by the projection in assembly and the connector is resilient to automatically return to its unflexed position when the projection is not displaced by and is received in a smaller diameter portion of the fuel adjustment valve, and in assembly the connector is arranged to be received within the cavity of the carburetor main body.

16. The device of claim 15 wherein the fuel adjustment valve includes an end having a serrated portion, a first reduced diameter portion adjacent to the end and a second reduced diameter portion axially spaced from the first reduced diameter portion by a distance equal to or greater than the axial length of the serrated portion, and wherein the adjustment limiting cap is movable from a first position to a second position on the fuel adjustment valve, and in the first position the projection is axially aligned with the first reduced diameter portion and the rotary connection feature is not engaged with the serrated portion of the fuel adjustment valve so that the fuel adjustment valve may be rotated relative to the adjustment limiting cap, and when the adjustment limiting cap is in its second position on the fuel adjustment valve the projection is axially aligned with the second reduced diameter portion and the rotary connection feature is engaged with the serrated portion of the fuel adjustment valve.

* * * * *